US008640875B2

(12) United States Patent
Garfinkle

(10) Patent No.: US 8,640,875 B2
(45) Date of Patent: Feb. 4, 2014

(54) TRAY HOLDER TAG SUPPORT

(76) Inventor: Benjamin L. Garfinkle, Piedmont, CA (US)

( * ) Notice: Subject to any disclaimer, the term of this patent is extended or adjusted under 35 U.S.C. 154(b) by 180 days.

(21) Appl. No.: 13/366,232

(22) Filed: Feb. 3, 2012

(65) Prior Publication Data

US 2013/0199963 A1 Aug. 8, 2013

(51) Int. Cl.
*G09F 3/00* (2006.01)

(52) U.S. Cl.
USPC ..... 206/557; 40/324; 40/658

(58) Field of Classification Search
USPC ..... 206/459.5, 557; 40/642.01, 651, 652, 40/648, 658, 324
See application file for complete search history.

(56) References Cited

U.S. PATENT DOCUMENTS

| | | | | |
|---|---|---|---|---|
| 4,882,862 | A * | 11/1989 | Slavsky, Sr. | 40/324 |
| 6,105,293 | A * | 8/2000 | Eason et al. | 40/645 |
| 7,036,778 | B2 * | 5/2006 | Ferrell | 248/213.2 |
| 7,874,088 | B2 * | 1/2011 | Nikols | 40/324 |
| 2009/0049724 | A1 * | 2/2009 | Alves et al. | 40/651 |
| 2009/0064554 | A1 * | 3/2009 | Alves et al. | 40/652 |

* cited by examiner

*Primary Examiner* — Jacob K Ackun
(74) *Attorney, Agent, or Firm* — Bay Area Technology Law Group PC

(57) ABSTRACT

A tray holder tag support for attachment of signage to an edge of a tray. The tray is characterized as having a base and upstanding sides emanating therefrom, at least one of the sides terminating in a lip, the lip having a width. The tray holder tag support includes a planar region which when applied to the tray extends proximate one of the side walls. A clip or pair of clips are provided each having a first segment appended to and extending from the planar region, the first segment(s) being of a length greater than the width of said lip. Second segment(s) extend substantially downwardly from the first segment(s) and third segment(s) extend from the second segment(s) and are sized to extend under the lip when the tray holder tag support is appended to the tray.

24 Claims, 4 Drawing Sheets

TRAY HOLDER TAG SUPPORT

TECHNICAL FIELD

The present invention deals with a tray holder tag support for attachment of signage to an edge of a tray displaying information to a consumer related to products contained in the tray. The tray holder tag support of this invention is uniquely constructed to enable it to releasably engage but firmly support signage at the edge of virtually any tray having upstanding sides, at least one of which terminates in a lip.

BACKGROUND OF THE INVENTION

Retailers, such as supermarket operators, routinely sell hundreds if not thousands of items, many of which are quite perishable. Many of these items are placed within trays which, in turn, are situated in, for example, refrigerated or heated cases.

In light of the myriad of products sold at any one time, it is imperative that signage provided to a consumer be clear, attractive and, most importantly, convey appropriate information pertinent to the particular item being sold in conjunction therewith. As it pertains to trayed product, signage should be displayed directly proximate each tray to avoid confusion.

In a cold or hot display case, in which multiple trays are arranged in close proximity to one another, providing the appropriate signage has proven most challenging. A single sign which attempts to identify multiple products can be confusing to the average consumer. Certainly if one product was being promoted at a special price, trying to determine which of the trayed items are "on special" can be a daunting task for any consumer.

Unlike other in-store displays, associating product information with individual trays can be difficult. A typical easel base can be an inappropriate support as store clerk movement within the case can tip over such signage. Also, products within trays can be wet or be associated with certain sauces and condiments which do not lend themselves to contact with an easel and other types of in-tray signage supports.

Further, unlike store shelves which have the typical C-channel receiving fixtures, trays can be of different sizes with differing side walls terminating in lips of varying dimensions. Thus, conventional tray signage either must be custom designed to fit particular trays which increases signage costs and reduces global application or ill fitting signage employed which can be easily dislodged.

It is thus an object of the present invention to provide a tray holder tag signage support which can be universally applied to virtually any cold or hot tray having a base, side walls and lip.

This and further objects will be more readily apparent when considering the following disclosure and appended claims.

SUMMARY OF THE INVENTION

A tray holder tag support for attachment of signage to an edge of a tray. The tray is characterized as having a base and upstanding sides emanating therefrom, at least one of the sides terminating in a lip, the lip having a width. The tray holder tag support includes a planar region which when applied to the tray extends proximate one of the side walls. A clip or pair of clips are provided each having a first segment appended to and extending from the planar region, the first segment(s) being of a length greater than the width of said lip. Second segment(s) extend substantially downwardly from the first segment(s) and third segment(s) extend from the second segments and are sized to extend under the lip when the tray holder tag support is appended to the tray. An optional web can be appended to the third segment(s) bridging them while a tag holder is affixed at or between the first segments releasably retaining signage visible to a consumer and related to products contained in the tray.

DETAILED DESCRIPTION OF THE INVENTION

Figure 1:
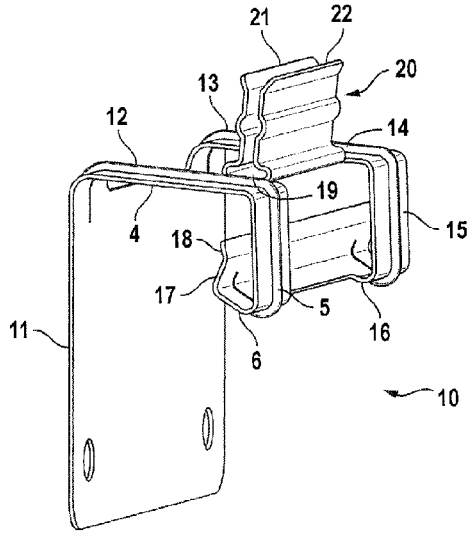
FIG. 1 is a perspective view of a first embodiment of the present invention.

Novel features which are characteristic of the invention, as to organization and method of operation, together with further objects and advantages thereof will be better understood from the following description considered in connection with the accompanying drawings, in which preferred embodiments of the invention are illustrated by way of example. It is to be expressly understood, however, that the drawings are for illustration description only and are not intended as definitions of the limits of the invention. The various features of novelty which characterize the invention are recited with particularity in the claims.

There has been broadly outlined more important features of the invention in the summary above and in order that the detailed description which follows may be better understood, and in order that the present contribution to the art may be appreciated. There are, of course, additional features of the invention that will be described hereinafter and which will form additional subject matter of the claims appended hereto. Those skilled in the art will appreciate that the conception upon which this disclosure is based readily may be utilized as a basis for the designing of other structures, methods and systems for carrying out the several purposes of the present invention. It is important therefore, that claims be regarded as including such equivalent constructions insofar as they do not depart from the spirit and scope of the present invention.

Certain terminology and the derivations thereof may be used in the following description for convenience and reference only, and will not be limiting. For example, words such as "upward," "downward," "left," and "right" refer to directions in the drawings to which reference is made unless otherwise stated. Similar words such as "inward" and "outward"

refer to directions toward and away from, respectively, the geometric center of a device or area and designated parts thereof. Reference in the singular tense include the plural and vice versa, unless otherwise noted.

Figure 2:
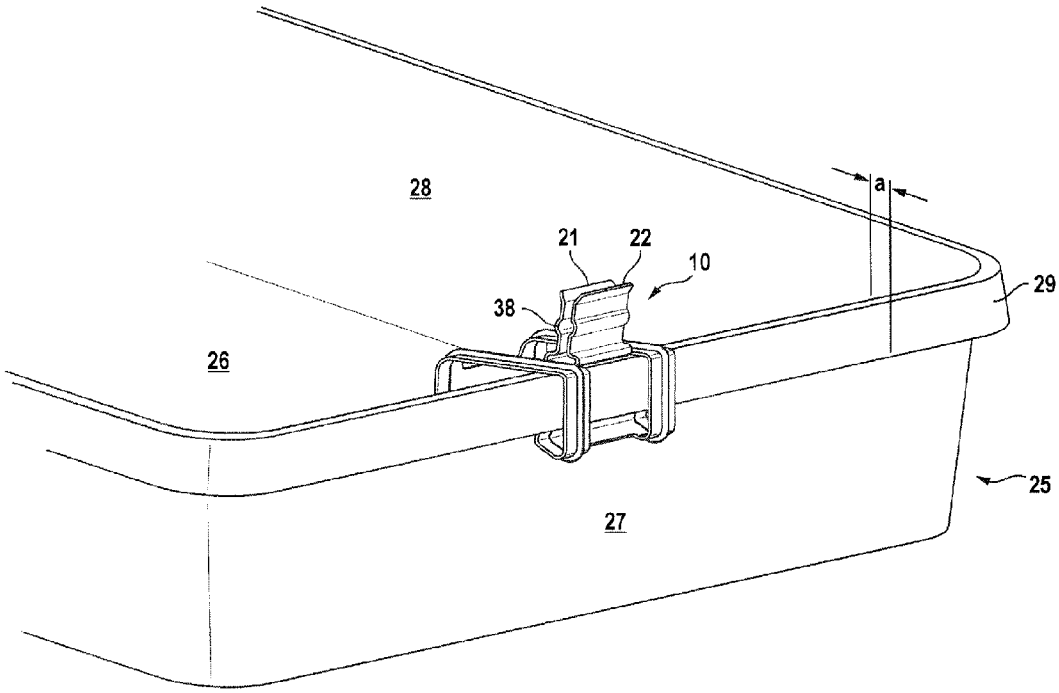
FIG. 2 is a perspective view of the embodiment of FIG. 1 employed with a typical tray used for displaying food and other products either alone or within a hot or cold display case.

Turning to FIGS. 1 and 2, a first embodiment of tray holder tag support 10 is shown alone and attached to tray 25. Tray 25 is depicted having base 26 and side walls 27 and 28 defining, together with opposite side walls, the interior space of tray 25.

Tray 25 is typical of trays containing consumer products and are often times arranged in a cold or hot case in a way to attract consumers and thus promote product sales. Such trays generally include lip 29 having a width "a."

Tray holder tag support 10 comprises planar region 11 which, when applied to tray 25 preferably extends against side wall 27 at the interior thereof. As a first embodiment, tray holder tag support 10 includes a pair of clips 12 and 13 extending from planar region 11. Clips 12 and 13 include first segments 4 and 14 being of a length greater than width "a" of lip 29, second segments 5 and 15 extending substantially downwardly from first segments 4 and 14 and preferably substantially parallel to planar region 11. As noted from FIG. 2, second segments 5 and 15 are of a length to extend below lip 29. Third segments 6 and 16 extend inwardly from second segments 5 and 15 toward side wall 27 and are sized to extend under lip 29 when tray holder tag support 10 is appended to tray 25 as shown. Optional web 17 is appended to third segments 6 and 16 of clips 12 and 13, web 17 extending beyond third segments 6 and 16 by having tail region 18 biased towards planar region 11.

In use, planar region 11 extends proximate to and is preferably biased against the interior of side wall 27 noting that when and if pressure contact is established between the interior surface of side wall 27 and planar region 11 a firm connective interface between tray holder tag support 10, side wall 27 and lip 29 results. Tray holder tag support is resistant to inadvertent removal or dislodgement and is capable of attachment to trays of various dimensions while being readily removed whenever store personnel wishes to do so, for example, when the tray is to be washed and stored for later use. The present invention functions by having the second and third segments (and optional web 17 together with tail region 18) snap into lip 29 enhanced by "tension" imposed by planar region 11.

Figure 6:
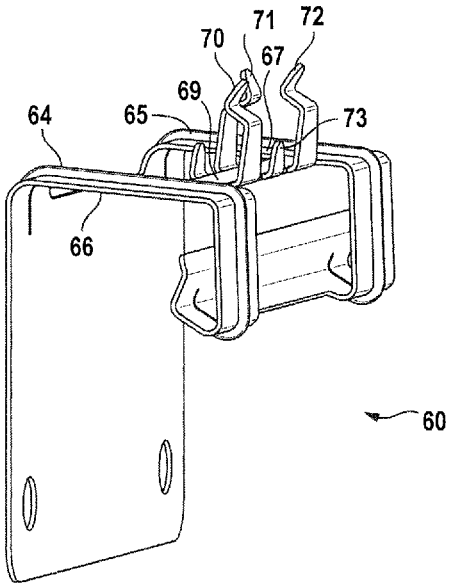
FIG. 6 is a perspective view of yet another embodiment of the tray holder tag support of the present invention.

Several variations of tray holder tag support 10 can be employed while remaining within the spirit and scope of the present invention. For example, in reference to FIG. 6, tray holder tag support 60 is illustrated having the same corresponding functional elements as discussed above with regard to FIG. 1. However, tray holder tag support 60 includes legs 70, 71 and 72 and optional protrusions 73 (collectively referred to as the tag holder holder portion of tray holder tag support 60) maintained on bridge 69 between clips 64 and 65 at first segments 66 and 67. The embodiment of FIG. 6 when employed as a tag holder as discussed above is ideally suited to receive a two dimensional card for displaying product information to a consumer. Such a card would slip between legs 70/72 on one side and by 71 on the other side and stabilized by protrusions 73.

Figure 9:
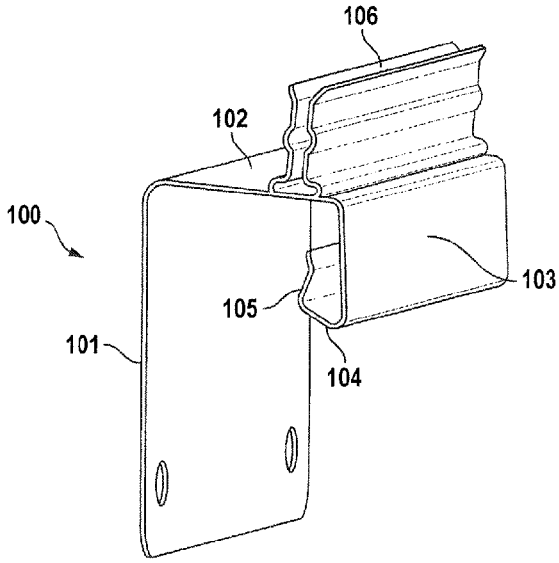
FIG. 9 is a perspective view of an alternative embodiment of the present invention.

A further embodiment of the tray holder tag support of the present invention can be appreciated by reference to FIG. 9. In this instance, clip pair 12 and 13 of FIG. 1 have been replaced by the structure illustrated as tray holder tag support 100. Specifically, although planar region 101 substantially replicates planar region 11, the clip is composed of a continuous first segment 102 appended to and extending from planar region 101, first segment 102 being of a length greater than the width of the sidewall and lip of the tray to which the tray holder tag support is appended. Second segment 103 extends substantially downwardly from first segment 102 and is of a length to extend below the lip of the tray. Third segment 104 extends inwardly from second segment 103 and toward the side wall of the tray being sized to extend under the lip when the tray holder tag support is appended to the tray. As with the previous embodiment, tag holder 106 is affixed to first segment 102 for releasably retaining signage visible to a consumer relating to products contained in the tray. Tray tag holder support 100 can also be provided with segment 105 akin to optional web 17 of the embodiment shown in FIG. 1. Segment 105 extends beyond third segment 104 and also preferably having a tail region biased towards planar region 101. Similar to the previously described embodiment of FIG. 1, second and third segments 103 and 104 and segment 105 snap onto the lip of a tray whose contact is enhanced by planar region 101.

Figure 10:
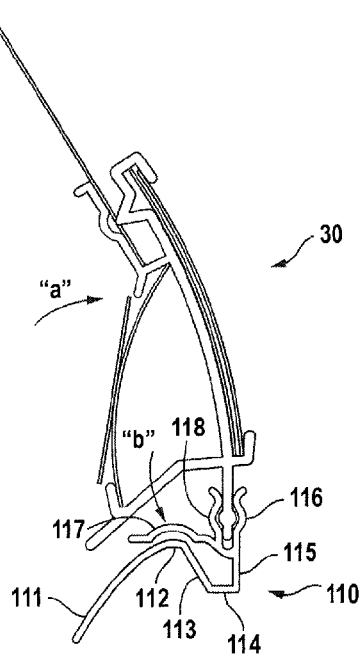
FIG. 10 is a side view of an alternative design of a tray holder and sign support of the present invention.

As yet a further embodiment of the tray holder tag support of the present invention, reference is made to FIG. 10 depicting alternative support 110, the design of which has been made the subject of U.S. Pat. No. D616,946. As in the other embodiments, tray holder tag support 110 is intended to support signage proximate an edge of a tray, the tray having a base and upstanding sides emanating therefrom, at least one of the upstanding sides terminating in a lip best depicted in FIGS. 7 and 8. The present embodiment comprises sloping region 111 which when applied to a tray, extends against an external face of one of its upstanding sides extending from its lip to its base. A lip, such as lip turned out section 83*a* (FIG. 7) will enter a slot between gripping segment 117 and the top of sloping region 111 at apex 112 and the combination of the gripping of the lip between 112 and 117 and the pressure exerted by sloping region 111 against the tray's side wall holds tray holder tag support 110 in place. Further, the tray holder tag support is provided with a tag holder in the form of legs 116 and 118 extending vertically from said gripping segment for releasably retaining signage 30, the details of which have previously been described. In addition, it is noted that tray holder tag support 110 flexes by the application of pressure along arrow "a", which can encourage its removal from the lip and side wall of the tray to which it is appended. This is most effective if the pan is first removed from the case. While the pan is in the case, it is normally surrounded by a full display of pans and, as such, there is little or no room for the clip to be removed.

Whether referring to the embodiment of FIG. 1 or the embodiments of FIGS. 9 and 10, the tray holder tag support is intended to mate with trays of various configurations while providing releasable but firmly supported signage related to product contained within the tray. In this regard, reference is made to FIGS. 7 and 8.

Figure 7:
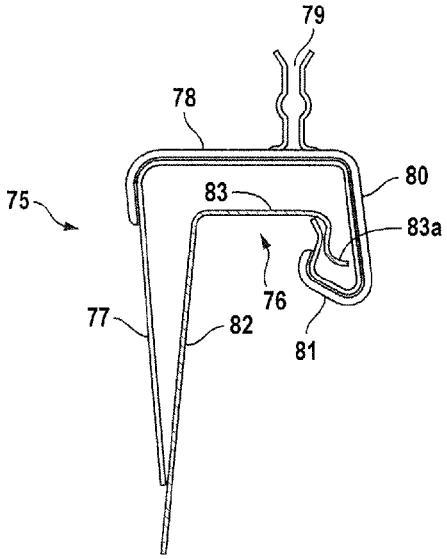
FIGS. 7 and 8 are crossectional views of typical trays supporting the tray holder tag supports of the present invention.
Figure 8:
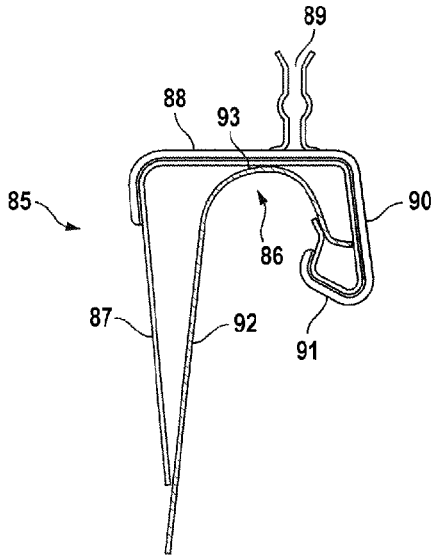

FIGS. 7 and 8 depict the present invention as crossectional side views as applied to trays of different configurations. Turning first to FIG. 7, tray holder tag support 75 is shown applied to tray 76 having side wall 82 and lip 83. Planar region 77 extends over and, in this instance, is biased against side wall 82 of tray 76. First segment 78 extends from planar region 77 being of a length greater than the width of lip 83 in order to capture lip 83 as shown while further supporting tag holder 79. Second segment 80 is of a length to extend below lip 83 while third segment 81 extends inwardly from second segment 80 toward side wall 82. In doing so, lip 83 is captured, the tray holder tag support locking behind turned out portion 83A. Thus, even though there is a gap between lip 83 and first segment 78, the positive contact at 83A provides for reliable signage support.

To further highlight the universal nature of the present invention, reference is made to FIG. 8 in which tray holder tag support 85 is shown seated upon tray 86 having side wall 92 and lip portion 93. As was the case with the embodiment of FIG. 7, tray holder tag support 85 is provided with planar region 87 biased against side wall 92. First segment 88 extends from planar region 87 and supports tag holder 89. Second segment 90 extends substantially downwardly from first segment 88 and preferably substantially parallel to planar region 87. Third segment 91 extends inwardly from second segment 90 towards side wall 92 and is sized to extend under lip 93 when tray holder tag support 85 is appended to tray 86 as shown. In this embodiment, it is noted that lip 93 of tray 86 is curved abutting against first segment 88. Although third segment 91 merely resides against lip 93 and without locking behind it (as compared to the embodiment of FIG. 7), a firm and reliable signage support is nevertheless established by the illustrated embodiment.

Figure 3:
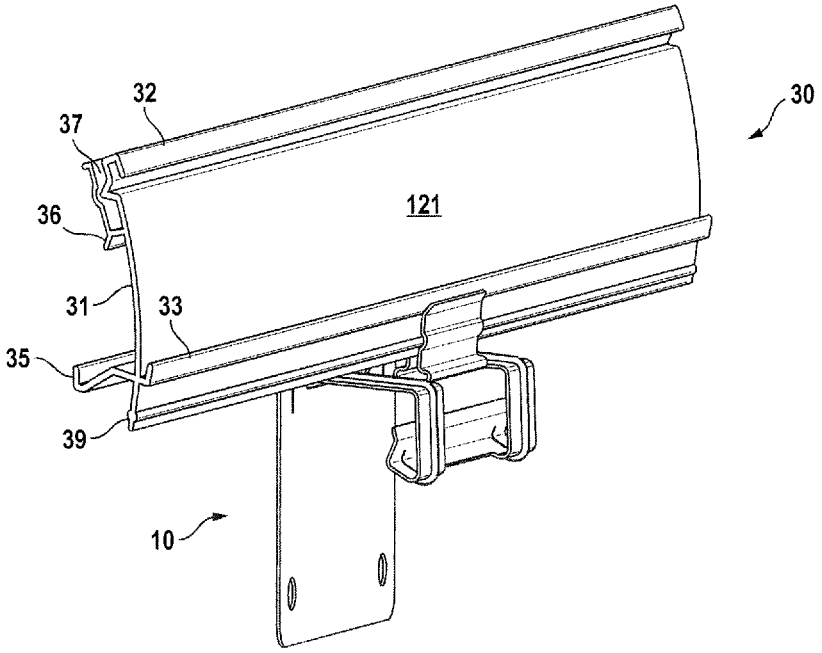
FIG. 3 is a perspective view of the tag holder of FIG. 1 in combination with a sign holder for displaying signage for use herein.

As an alternative to the embodiment of FIG. 6, reference is once again made to FIG. 1 viewed in conjunction with FIGS. 2 and 3. In this embodiment, tag holder 20, including legs 21 and 22, is again supported and affixed between clips 12 and 13 by bridge 19 extending between first segments 4 and 14. Tag holder 20 is ideally suited to receive, for example, sign holder 30 (FIG. 3) which includes bead 39 for capture by legs 21 and 22 in region 38 (FIG. 2). Sign holder 30 is made the subject of U.S. D614,239, the disclosure of which is incorporated by reference. Other sign holders can also be used such as that disclosed in U.S. D614,240, the disclosure of which is incorporated by reference.

Figure 4A:
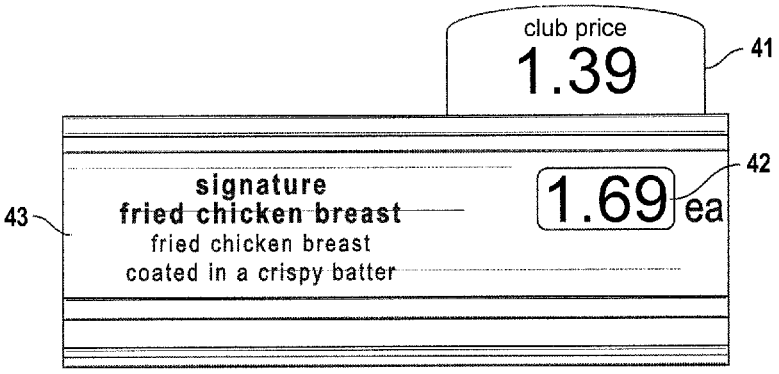
FIGS. 4A and 4B are front and back plan views, respectively, of the signage of FIG. 3 shown with typical product and pricing inserts for use herein.
Figure 4B:
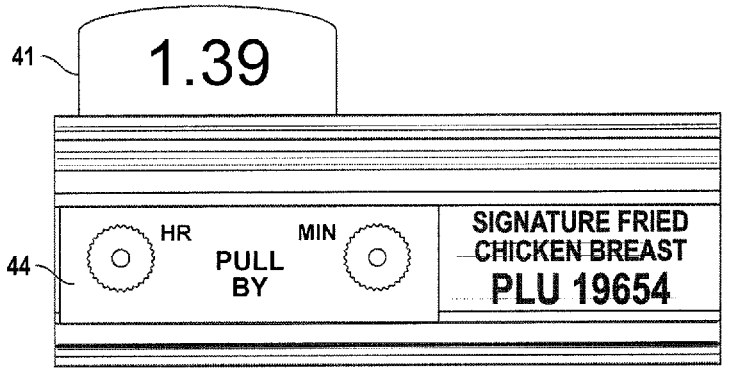
Figure 5:
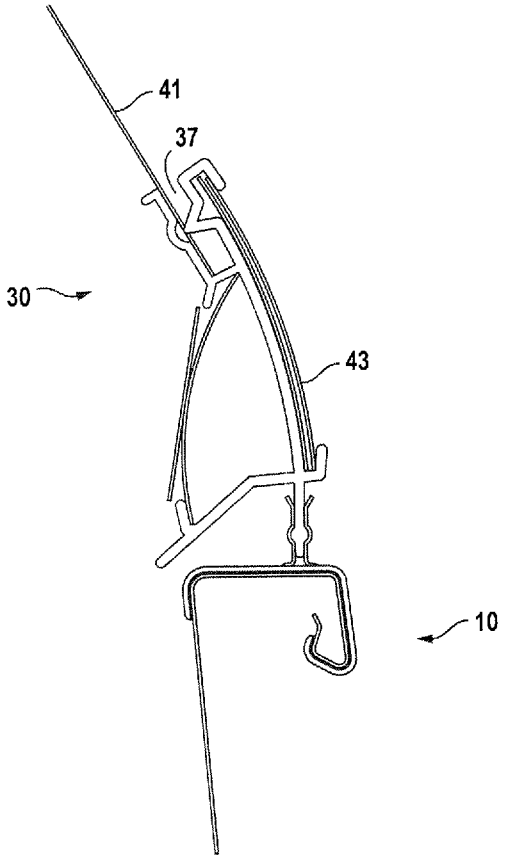
FIG. 5 is a side view of the tray holder and signage support of FIG. 3.

Sign holder 30 generally comprises first face 121 having at least one track extending between grooves 32 and 33. Signage 43 can be slipped between grooves 32 and 33 for displaying information intended to be read by a consumer. Pricing information 42 can be positioned behind a cut-out in signage 43 as shown in FIG. 4A. Oftentimes, information related to products contained within the subject tray is repeated on the back of the signage for the benefit of counter staff. As sign holder 30 is transparent, information displayed on the back of sign 43 including such things as PLU numbers can be viewed by counter staff. When the signage is opaque, an opening can be provided in sign holder 30 to enable information on the back side of signage 43 to be made available to counter staff therethrough. Such an embodiment is shown in U.S. Pat. No. D614,240.

Sign holder 30 can be provided with at least one track defined by grooves 35 and 36 on rear face 31 of sign holder 30. Rear face 31 could be provided, for example, with a rotating wheel or similar indicia 44 informing the clerk when product within the tray should be removed or pulled from the case if not sold. This type of signage is made the subject of U.S. Patent Application Publication No. 2009/0188140, the disclosure of which is incorporated by reference herein.

Sign holder 30 can also optionally be provided with track 37 proximate its top edge for receipt and display of supplemental signage 41.

In light of the above discussion, it is readily apparent that the tray holder tag support is not only configured to universally engage trays of a wide variety of sizes and shapes, but can also be provided with tag holders capable of removably receiving a wide variety of signage visible both to the consumer as well as to store personnel. Such signage is maintained in a visually pleasing proper orientation requiring positive and intentional removal by store personnel when appropriate.

The above disclosure is sufficient to enable one of ordinary skill in the art to practice the invention, and provides the best mode of practicing the invention presently contemplated by the inventor. While there is provided herein a full and complete disclosure of the preferred embodiments of the invention, it is not desired to limit the invention to the exact construction, dimensions, relationships, or operations as described. Various modifications, alternative constructions, changes and equivalents will readily occur to those skilled in the art and may be employed as suitable without departing from the true spirit and scope of the invention. Such changes might involve alternative materials, components, structural arrangements, sizes, shapes, forms, functions, operational features or the like. Therefore, the above description and illustration should not be considered as limiting the scope of the invention, which is defined by the appended claims.

What is claimed is:

1. A tray holder tag support for attachment of signage to an edge of a tray, said tray having a base and upstanding sides emanating therefrom, at least one of said upstanding sides terminating in a lip, said lip having a width, said tray holder tag support comprising a planar region which when applied to said tray, extends proximate one of said upstanding sides, a pair of clips each having a first segment appended to and extending from said planar region, said first segments being of a length greater than the width of said lip, second segments extending substantially downwardly from said first segments and of a length to extend below said lip, and third segments extending inward from said second segments toward said side wall and sized to extend under said lip when said tray holder tag support is appended to said tray, and a tag holder affixed between said first segments for releasably retaining said signage visible to a consumer and related to products contained in said tray.

2. The tray holder tag support of claim 1 further comprising a web appended to said third segments bridging said pair of clips.

3. The tray holder tag support of claim 1 further characterized as having a tail region biased towards said planar region.

4. The tray holder tag support of claim 1 wherein said tag holder is affixed to a bridge extending between said pair of clips at said first segment thereof.

5. The tray holder tag support of claim 1 wherein said tag holder comprises legs for releasably receiving a substantially two dimensional card displaying product information to a consumer.

6. The tray holder tag support of claim 4 wherein said tag holder comprises legs for receipt of a sign holder, said sign holder comprising a first face, said first face having at least one track to receive signage positioned with respect to said tray to provide product information visible to a consumer facing said tray.

7. The tray holder tag support of claim 6 wherein said sign holder comprises a rear face having at least one track to receive product information visible to a counter clerk, but not to a consumer facing said tray.

8. The tray holder tag support of claim 6 wherein said sign holder comprises a track proximate a top edge of said sign holder for receipt and display of product information in addition to that information contained in said at least one track.

9. The tray holder tag support of claim 1 wherein said upstanding sides comprise exterior surfaces and interior surfaces, said interior surfaces together with said base defining the interior of said tray, said planar region being biased against said interior surface of one of said upstanding sides when said tray holder tag support is attached thereto.

10. The tray holder tag support of claim 9 wherein said planar region is in pressure contact with said at least one of said upstanding sides when said tray holder tag support is attached thereto.

11. The tray holder tag support of claim 1 wherein said second segments are substantially parallel to said planar region.

12. In combination, a tray and tray holder tag support for displaying signage visible to a consumer and related products contained in said tray, said tray comprising a base and upstanding sides emanating therefrom, at least one of said upstanding sides terminating in a lip, said lip having a width, said tray holder tag support comprising a planar region which when applied to said tray, extends proximate one of said upstanding sides, a pair of clips each having a first segment appended to and extending from said planar region, said first segments being of a length greater than the width of said lip, second segments extending substantially downwardly from said first segments and a length to extend below said lip, and third segments extending inward from said second segments toward said side wall and sized to extend under said lip when said tray holder tag support is appended to said tray, and a tag holder affixed between said first segments for releasably retaining signage visible to a consumer and related to product contained in said tray.

13. The combination tray and tray holder tag support of claim 12 further comprising a web appended to said third segments bridging said pair of clips.

14. The combination tray and tray holder tag support of claim 13 wherein said web is further characterized as extending beyond said third segments by having a tail region biased towards said planar region.

15. The combination tray and tray holder tag support of claim 12 wherein said tag holder is affixed to a bridge extending between said pair of clips at said first segment thereof.

16. The combination tray and tray holder tag support of claim 12 wherein said tag holder comprises legs for releasably receiving a substantially two dimensional card displaying product information to a consumer.

17. The combination tray and tray holder tag support of claim 15 wherein said tag holder comprises legs for receipt of a sign holder, said sign holder comprising a first face, said first face having at least one track to receive signage positioned with respect to said tray to provide product information visible to a consumer facing said tray.

18. The combination tray and tray holder tag support of claim 17 wherein said sign holder comprises a rear face having at least one track to receive product information visible to a counter clerk, but not to a consumer facing said tray.

19. The combination tray and tray holder tag support of claim 17 wherein said sign holder comprises a track proximate a top edge of said sign holder for receipt and display of product information in addition to that information contained in said at least one track.

20. The combination tray and tray holder tag support of claim 12 wherein said upstanding sides comprise exterior surfaces and interior surfaces, said interior surfaces together with said base defining the interior of said tray, said planar region being biased against said interior surface of one of said upstanding sides when said tray holder tag support is attached thereto.

21. The combination tray and tray holder tag support of claim 20 wherein said planar region is in pressure contact with said at least one of said upstanding sides when said tray holder tag support is attached thereto.

22. A tray holder tag support for attachment of signage to an edge of a tray, said tray having a base and upstanding sides emanating therefrom, at least one of said upstanding sides terminating in a lip, said lip having a width, said tray holder tag support comprising a planar region which when applied to said tray, extends proximate one of said upstanding sides, a clip having a first segment appended to and extending from said planar region, said first segment being of a length greater than the width of said lip, a second segment extending substantially downwardly from said first segment and of a length to extend below said lip, and a third segment extending inward from said second segments toward said side wall and sized to extend under said lip when said tray holder tag support is appended to said tray, and a tag holder affixed to said first segment for releasably retaining said signage visible to a consumer and related to products contained in said tray.

23. A tray holder tag support for attachment of signage to an edge of a tray, said tray having a base and upstanding sides emanating therefrom, at least one of said upstanding sides terminating in a lip, said tray holder tag support comprising a sloping region having an apex which when applied to said tray, extends against and in pressure contact with an external surface of an upstanding side of said tray extending from said lip to said base and a gripping segment extending proximate to said apex creating a slot sized to receive and to releasably capture a portion of said lip segment and extending vertically upward of said gripping segment, a tag holder for releasably retaining said signage visible to a consumer and related to products contained in said tray.

24. The tray holder tag support of claim 23 wherein upon flexing said tag holder away from said tray, said lip is releasable from said slot encouraging release of said tray holder tag support from said tray.

* * * * *